United States Patent [19]

Joseph

[11] 3,995,872

[45] Dec. 7, 1976

[54] ATTACHMENT

[76] Inventor: Claude Joseph, 74700 Sallanches, France

[22] Filed: Aug. 22, 1975

[21] Appl. No.: 606,939

[52] U.S. Cl. ..... 280/11.37 H

[51] Int. Cl.[2] ..... A63C 11/22

[58] Field of Search ..... 280/11.37 H, 11.37 B, 280/11.37 D, 11.37 R, 11.37 E

[56] References Cited

UNITED STATES PATENTS 3,658,356 4/1972 Van Reyper ..... 280/11.37 H

FOREIGN PATENTS OR APPLICATIONS 18,861 1/1905 Sweden ..... 280/11.37 B 488,471 5/1970 Switzerland ..... 280/11.37 H

*Primary Examiner*—Robert R. Song
*Assistant Examiner*—Milton L. Smith
*Attorney, Agent, or Firm*—Robert E. Burns; Emmanuel J. Lobato; Bruce L. Adams

[57] ABSTRACT

A looped leash is clipped to a ski pole, below the pole handle, by a C-shaped resilient clip having an enlarged central projection with an opening in which the leash is secured. The clip is tightly force fitted about the pole but allows release of the leash in the event of an excessive force applied to the clip. Screw means can be provided for adjustment of the release force.

7 Claims, 3 Drawing Figures

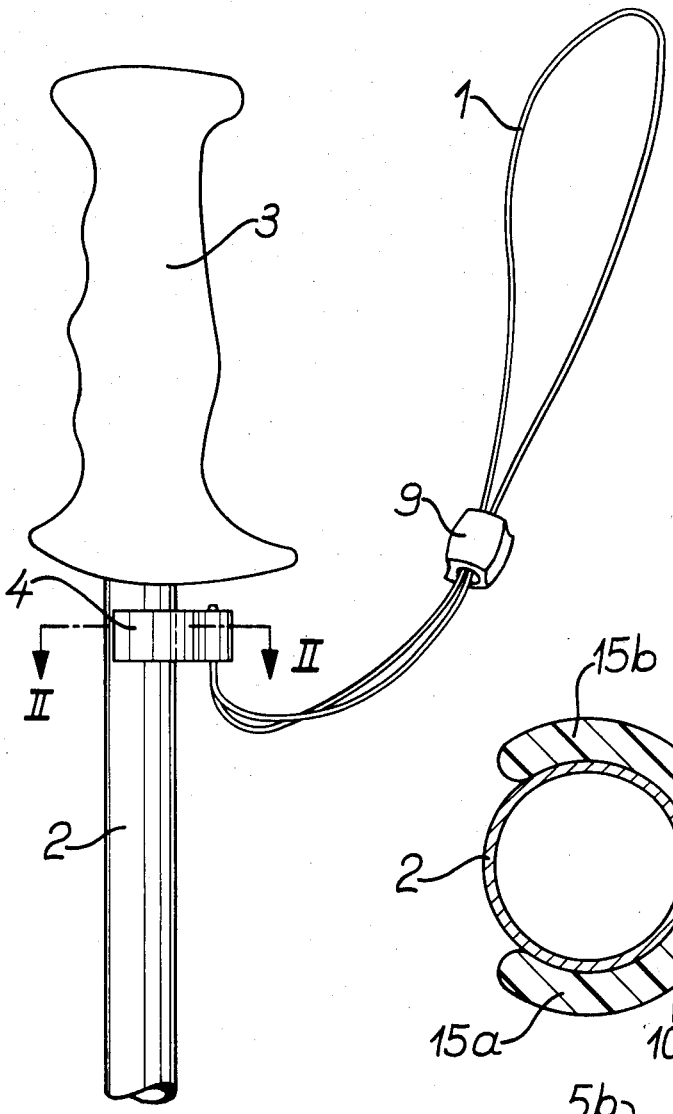
FIG. 1
FIG. 3
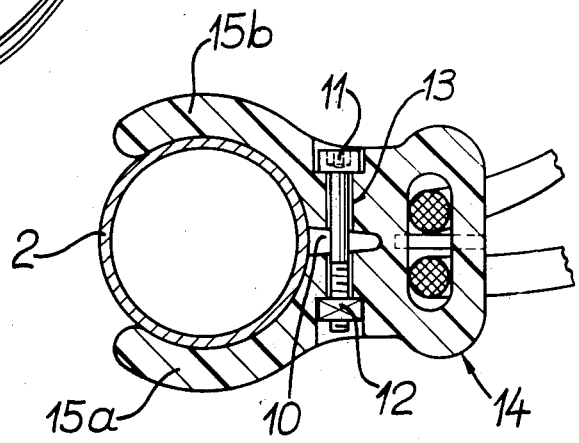
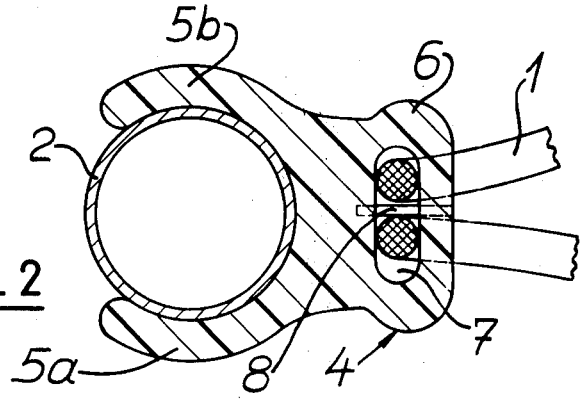
FIG. 2

ATTACHMENT

BACKGROUND OF THE INVENTION

The invention relates to ski-pole attachments comprising a looped leash and means for releasably securing the leash to a ski pole.

Many skiing accidents have involved injury to skier's arms and wrists, when the ski pole becomes jammed and the wrist is caught in a looped leash attached to the top of the ski pole handle.

To avoid such injury, several devices have been proposed to allow release of the leash from the ski pole in the case of excessive traction, but the devices proposed to date have all involved various drawbacks such as a complicated construction involving the assembly of several parts and the need to provide the ski pole with a special handle to accomodate the release device. These devices have consequently not found favor and have not significantly contributed to reduce injuries of the mentioned type.

SUMMARY OF THE INVENTION

An object of the invention is to provide a device for releasably securing a looped leash onto a ski pole to provide for an adequate safety release, without any need for a special type of handle on the ski pole.

The invention accordingly provides an improvement in a skipole security attachment comprising a looped leash and means for releasably securing said leash to a ski pole, wherein said securing means comprises a single piece of resilient material in the form of a generally U or C-shaped clip having a central body portion protruding outwardly of the center of the U or C and two resilient arms extending from said central body portion for gripping about a cylindrical ski-pole over a major part of its circumference. These arms are resiliently distendable for force-fitting of said piece on a ski-pole and for allowing release of said piece and said leash from the pole in the event of a force exerted on said piece by said leash greater than a given value. The attachment also has means, such as an opening in which ends of the leash are jammed, for firmly securing the leash to said central body portion of said piece.

The invention therefore comprises an attachment which fits directly on the ski pole just under the handle, in contrast to securing of the leash at the top of the handle as in known devices, and consequently can be fitted to practically all types of ski poles, even to old poles from which existing leashes may be removed from the handle. The attachment may thus either be sold separately, or already fitted onto ski poles.

In one specific embodiment, the force of gripping of the clip piece on a ski pole is made adjustable by providing a inner split in the central body portion to allow moving of the arms together and apart by resilient deformation of said body portion, and screw means for setting the spacing of the arms.

BRIEF DESCRIPTION OF THE DRAWINGS

Embodiments of the invention will now be described in detail with reference to the accompanying drawings, in which:

FIG. 1 is an elevational view of part of a ski pole fitted with an attachment according to the invention;

FIG. 2 is a cross-section along line II—II of FIG. 1; and

FIG. 3 is a view similar to FIG. 2 of another embodiment of attachment.

DESCRIPTION OF THE PREFERRED EMBODIMENTS

The attachment of FIGS. 1 and 2 comprises a flexible leash 1, for example made of cord, formed into a loop whose two ends are secured to a ski pole 2 in a cylindrical zone just under pole handle 3 by means of a removable clip 4. The clip 4 is a piece of slightly resilient material such as a synthetic plastic material having a rounded - U or C-shaped part with two alike facing arcuate arms *5a*, *5b*. When unstressed, the arms *5a*, *5b* define with the inner surface of a central body portion 6 of clip 4 a generally cylindrical inner face whose diameter is slightly less than that of pole 2 so as to tightly fit about pole 2 over a major part of its circumference. The gripping force of clip 4 on pole 2 will have a given value, which may be chosen as a function of the skier by suitably correlating the pole and clip diameters. This gripping force will depend on the spacing between the two arms of the clip and on the material chosen.

To ensure a sufficient gripping force of clip 4 on pole 2, the depth of the U or C will always be chosen greater than the radius of the ski pole to which the attachment is to be fitted.

The enlarged central body portion 6 of clip 4 protrudes outwardly of the center of the U or C and has an oblong hole 7 formed perpendicular to the plane of the C or U and to the ski axis, to receive the ends of leash 1. As shown, hole 7 is divided into two sections by a pin 8, or alternatively by a partition formed integrally during molding. The two ends of the looped leash 1 are fixed in these sections and are secured together above pin 8, for example by welding.

A sliding piece or slide 9 is fitted on the two strands of the looped leash 1 to permit adjustment of the loop about the skier's wrist at will.

FIG. 3 shows another embodiment of the clip 4 force of gripping on ski pole 2, and hence the required release effort, can be set at will. In this embodiment, a clip 14 of rounded-U or C shape has facing arcuate arms *15a*, *15b* for gripping about ski pole 2, and a central body portion with an inner axial slot 10 leading into the U or C to permit moving of arms *15a*, *15b* towards and away from one another by resilient deformation of the enlarged body portion. A cross-bore is provided through slot 10 to receive a cylindrical-headed screw 11 and a nut 12. The head of screw 11 is rotatably countersunk and the nut 12 non-rotatably countersunk each in an appropriate recess, head 11 having an inner hexagonal recess to receive an Allen key. By turning screw 11, the spacing of arms *15a*, *15b* when unstressed and hence the pressure on the ski pole 2 when the arms are fitted about the pole and stressed can be regulated to set a suitable release effort of the clip 14 and its leash.

In both embodiments, the clip can be slid by the skier on the cylindrical pole shank to a desired height, for example so that if the skier opens his hand the pole remains suspended from his wrist at a height facilitating immediate grasping of the handle.

The sliding piece 9 for adjusting the loop length can also serve for attaching together a pair of poles when they are not in use.

As an alternative to a cord, the leash may be formed as a flat strap the ends of which can be jammed in an oblong opening of suitable tapered shape, for example by passing the flat ends through the narrow end of the opening, folding each end in to form a doubled width, attaching the doubled ends together by stapling or otherwise, and pulling the leash to jam the widened end in the opening.

What is claimed is:

1. In a ski-pole security attachment comprising a looped leash and means for releasably securing said leash to a ski pole, the improvement wherein said securing means comprises a single piece of resilient material in the form of a generally U or C-shaped clip having a central body portion protruding outwardly of the center of the U or C and two resilient arms extending from said central body portion for gripping about a cylindrical ski-pole over a major part of its circumference; said arms being resiliently distendable for force-fitting of said piece on a ski pole and for allowing release of said piece and said leash from the pole in the event of a force exerted on said piece by said leash greater than a given value, and means for firmly securing said leash to said central body portion of said piece.

2. A ski-pole attachment according to claim 1, comprising means for adjusting the spacing of said arms to set the gripping force of said piece on a ski pole.

3. A ski- pole attachment according to claim 2, in which said adjusting means comprise means defining an inner slot in said central body portion to permit moving of said arms together and apart by resilient deformation of said body portion, and screw means for setting the spacing of said arms.

4. A ski-pole attachment according to claim 1, in which said means for securing said leash comprise means defining at least one oblong opening through said central body portion perpendicular to the general plane of said U or C, said leash having ends secured in said opening(s).

5. A ski-pole attachment according to claim 1, in which said arms and said central body portion define a smooth continuous generally cylindrical inner surface.

6. A ski-pole attachment according to claim 5 in combination with a ski pole having a cylindrical shank, in which the diameter of said generally cylindrical inner surface when said arms are unstressed is less than the diameter of said cylindrical shank of the ski pole.

7. A ski-pole attachment according to claim 1 in combination with a ski pole including a cylindrical shank having a handle secured at one end, in which said piece is releasably secured and is slidable on said cylindrical shank to a desired location spaced-apart from and below said handle.

* * * * *